United States Patent [19]

Stoss

[11] Patent Number: 4,971,140

[45] Date of Patent: Nov. 20, 1990

[54] PROCESS AND EQUIPMENT FOR THE MAINTENANCE OF THE SECONDARY SECTION OF A HEAT EXCHANGER

[75] Inventor: Johannes Stoss, Nuremburg, Fed. Rep. of Germany

[73] Assignee: Siemens Aktiengesellschaft, Berlin and Munich, Fed. Rep. of Germany

[21] Appl. No.: 455,529

[22] Filed: Dec. 22, 1989

[51] Int. Cl.[5] ..... F28G 9/00

[52] U.S. Cl. ..... 165/95; 122/392; 165/5

[58] Field of Search ..... 165/5, 95; 122/379, 122/390, 391, 392

[56] References Cited

U.S. PATENT DOCUMENTS

| | | | |
|---|---|---|---|
| 3,661,124 | 5/1972 | Winkin | 122/392 |
| 4,025,362 | 5/1977 | Frauenfeld | 165/5 |
| 4,273,076 | 6/1981 | Lahoda et al. | 122/382 |
| 4,424,769 | 1/1984 | Charamathieu et al. | 122/392 |
| 4,428,417 | 1/1984 | Chesner | 165/5 |
| 4,445,465 | 5/1984 | Byrd et al. | 122/392 |
| 4,487,165 | 12/1984 | Weber et al. | 165/95 |
| 4,515,747 | 5/1985 | Creek et al. | 376/249 |
| 4,526,135 | 7/1985 | Calhoun et al. | 122/392 |
| 4,640,346 | 2/1987 | Weber et al. | 165/95 |
| 4,718,376 | 1/1988 | Leroueil et al. | 122/392 |
| 4,769,085 | 9/1988 | Booij | 122/392 |
| 4,850,423 | 7/1989 | Allen et al. | 165/5 |

FOREIGN PATENT DOCUMENTS

| | | | |
|---|---|---|---|
| 710205 | 5/1965 | Canada | 165/5 |
| 2345721 | 3/1975 | Fed. Rep. of Germany | 165/95 |
| 3544716 | 8/1986 | Fed. Rep. of Germany | 165/95 |
| 33299 | 2/1987 | Japan | 165/95 |
| 8807156 | 9/1988 | World Int. Prop. O. | 122/392 |

*Primary Examiner*—John Rivell
*Assistant Examiner*—L. R. Leo
*Attorney, Agent, or Firm*—Peter A. Luccarelli, Jr.

[57] ABSTRACT

A manipulator head (15) equipped with a nozzle (15*a*), a tool or a probe is connected to a first flexible tube (16) which is wound on a drum (18) which is mounted at a first service opening (13). The head (15) is inserted through the first service opening (13) into a tube lane or a tube column of the tube bundle of a heat exchanger and drawn out of a second service opening (14). There the head (15) is connected to the free end of a second flexible tube (17) which is wound onto a second drum (19) at the second service opening (14). By activating one of the two drums, the head (15) is moved through the heat exchanger along the tube lane and/or the tube column. If the head (15) is equipped with a nozzle (15*a*), the nozzle is supplied through a line with cleaning fluid under pressure, at least through the first flexible tube (16) and the respective drum (18).

23 Claims, 8 Drawing Sheets

PROCESS AND EQUIPMENT FOR THE MAINTENANCE OF THE SECONDARY SECTION OF A HEAT EXCHANGER

TECHNICAL FIELD

The invention concerns a process and equipment for the maintenance of the secondary section of a heat exchanger and is particularly well suited for the remote-controlled removal of deposits on tubes in the tube manifold sheet area and/or on spacing plates in a bundle of tubes. The subject of the invention may also be used to introduce a tool or a probe, for example, a videoscope, into a secondary section of a heat exchanger when the section contains a bundle of tubes.

BACKGROUND OF THE INVENTION

Equipment for cleaning the tube sheet in the secondary section of a steam generator that includes a heat exchanger with an enclosure, in whose lower portion is located a tube sheet which divides the circuits for a primary and a secondary medium from one another, is known from U.S. Pat. No. 4,424,769. On the primary side, tubes open into the tube sheet, which, combined in a U-shaped bundle, extend into the space through which the secondary medium flows. The housing has closable service openings, such as hand holes and inspection ports, through which spacing plates for the tubes in the tube bundle, a tube lane between the sides of the tube bundle and tube columns between the individual tubes, can be accessed. A flat nozzle head is used to clean the pipe assembly; it is connected with two or more tubes mounted on top of one another to store a cleaning liquid. These tubes arranged on top of one another are sheathed in such a manner that a strip-shaped guiding element with a rectangular cross section is formed. At one of the hand holes, there is fastened a guide and drive unit, by means of which the strip-shaped guiding element with the nozzle head is inserted into a tube lane or a tube column of the steam generator. In this case, the nozzle head is moved step by step, so that the cleaning fluid, which emerges from the nozzle at a very high pressure of at least 200 bar, is only sprayed into the respective tube columns and not on the tubes. Since the nozzle head and the strip-shaped guiding element are designed to be very narrow, the nozzle head can also be introduced into the tube column at right angles to the tube lane, and the tube sheet can be cleaned on either the x- or the y-axis. The particles removed are drawn off by suction at the periphery between the bundle and the crossbaffle of the heat exchanger by tubes inserted there. The tubes that feed the cleaning fluid are sheathed in such a manner that there is a rigid feed line in the vertical direction and a flexible feed line in the horizontal direction. Nevertheless, there is no sure way of preventing the strip-shaped guiding element with the spray head attached to its free end from bending or twisting in the wide tube lane in an undesirable manner. In this familiar embodiment, a discharging propulsion mechanism is provided at the service opening, which consists of a large number of driven and undriven rollers, which bend and guide the feedline in the horizontal plane.

Equipment to clean off the deposits on the tube side of a steam generator is already known from U.S. Pat. No. 4,273,076. In it, a nozzle head is mounted on a rigid lance, which is inserted through the hand hole into the tube lane of the steam generator and which holds the nozzle head in any desired position. To drain off the fluid/sludge mixture, there are used a suction tube inserted in a hand hole and a tube located in an opposite hand hole, which ejects a washing fluid that generates a peripheral flow to the suction tube. In this familiar embodiment, there must be sufficient space outside the steam generator to permit the lance to be inserted into the tube lane. It is not possible to insert the lance into the tube column transversely to the tube lane.

The purpose of the invention is to describe a process and equipment with which service work can be performed on the secondary section of heat exchangers when the access is restricted, for example, because there is only a limited free space outside a service opening (hand hole or inspection port).

In addition, it should be possible to introduce a head equipped with a nozzle, a tool or a probe through a very small port—for example, one smaller than or equal to 51 mm—in a heat exchanger and to reach interior components, for example, a web plate in the heat exchanger. When the head is moved forward in the tube bundle, it must maintain a stable position. In addition, the equipment should permit the tube columns to be cleaned from the tube lane in the x-direction and from the middle tube column outward in the y-direction with one and the same head.

SUMMARY OF THE INVENTION

A first solution of this problem consists, according to the invention, in a process for the maintenance of the secondary action of a heat exchanger, in particular, for the remote-controlled removal of deposits in the tube sheet area and/or on the spacing plates of a tube bundle, whose housing is provided with at least two closable service openings such as hand holes or inspection ports, through which the spacing plates, a tube lane and/or tube columns are accessible, in which a manipulator head, equipped with a nozzle, a tool or a probe is connected with a first flexible tube wound on a drum, the head is introduced through a service opening into the tube bundle, in particular, into a tube lane or a tube column, brought out through another service opening and connected to the free end of a second flexible tube, which is wound on a second drum, with the head being moved by remote control through the heat exchanger, in particular, along the tube lane and/or the tube column through the action of one of the two drums, and, when the head is equipped with a nozzle, with cleaning fluid being fed under pressure to the nozzle by means of a line, at least through the first flexible tube and the respective drum.

A second solution consists, according to the invention, in a process for the maintenance of the secondary section of a heat exchanger, in particular, for the remote-controlled removal of deposits in the tube sheet area and/or on spacing plates of a tube bundle, whose housing is provided with at least two closable service openings such as hand holes and/or inspection ports, through which the spacing plates, a tube lane and/or tube columns are accessible, in which a manipulator head equipped with a nozzle, a tool or a probe is connected on two opposite sides with the first ends of two flexible tubes. The second end of the first flexible tube is wound onto a drum; the free end of the second flexible tube is brought through a first service opening and the tube bundle, in particular, through the tube lane or a tube column, brought out through a second service opening and wound onto a second drum. When one of the two drums is activated, the head is moved by remote control through the heat exchanger, in particular, along the tube lane and/or the tube column, and, when the head is equipped with a nozzle, cleaning fluid is fed under pressure to the nozzle by means of a line, at least through the first flexible tube and the respective drum.

Common to both solutions is the fact that no guide unit and no large free space in front of the service openings of the heat exchanger are required to move the head within the heat exchanger. Compared with the familiar mounting on one side of the head on a strip-shaped guiding element, a non-twisting, stable movement of the head is achieved, because it is held and guided on two sides.

It is desirable for the head or the free end of the second flexible tube to be introduced into the tube bundle by means of an inserting tool. This inserting tool can be mounted at a service opening—for example, with a screw—prior to the insertion of the head.

It is advantageous if the drive motors of the drums are provided with devices to determine the path, if signal values relating to the path of the head are conducted for display to a control system and if the head is guided step by step to a predetermined position with the aid of the control system, in accordance with theoretically determined values.

The step-by-step guidance of the head can also be made dependent on the power that is used in one or both of the motors that drive the drums.

In the case of a manipulator whose head is provided with at least one nozzle, the thrust of the nozzle jet can be directly or indirectly determined in order to derive the position of the head in the tube column from measured values. An efficient method is to determine the thrust of the jet from a nozzle on the head, in particular, the pressure on the bearings of at least one of the drums, or the tensions on at least one of the flexible tubes, as signal values and to feed them into the control system, in which case the position of the head with respect to a tube column or a tube is determined from the signal values.

Also contemplated by the invention is equipment for the maintenance of a heat exchanger, in particular, the remote controlled dissolving and removal of deposits on the tube sheet and/or on spacing plates of a tube bundle, whose enclosure is provided with at least two closable service openings such as hand holes and/or inspection ports, through which the spacing plates, a tube lane and/or tube columns are accessible, in particular, for the implementation of the process according to the claims, in which the manipulator head equipped with a nozzle, a tool or a probe has a width of less than about 8 mm and a height of less than 50 mm and can be moved by two flexible tubes, whose first ends are attached to two opposite sides of the head and whose second ends are brought out of two service openings and wound onto remote-controlled drums. Electrical energy and/or liquid under pressure is fed from feed sources by a control system, over lines, to one of the two drums and from there, over at least one of the flexible tubes to the head. When the head is equipped with a nozzle, at least one suction device is provided to remove the dissolved deposits.

This present invention not only permits cleaning on the y-axis or x-axis of a heat exchanger; the head can also be guided for a certain distance through the tube lane and for a certain distance through a tube column, so that a hybrid path on both the x- and y-axes is possible. In this case, the inspection ports can also be smaller than 51 mm. In the event that inspection ports are provided above or between the individual spacing plates, the spacing plates can be cleaned in addition to the heat tubes. If the spacing plates are cleaned in a sequence moving from top to bottom the removed deposits will flow downward to the tube sheet, from which they can ultimately be removed by suction in a simple manner.

Using the equipment and the process in accordance with the invention, it is therefore possible, in principle, to clean the entire secondary section of the heat exchanger, to improve the heat transfer by dissolving the deposits on the tubes in the vicinity of the spacing plates, and thus to reduce—or even to prevent—damage to the heat tubes at these locations through so-called "denting."

It is desirable to fasten the first drum to a first service opening and the second drum to a second service opening in such a manner that they can be removed. The drums can be easily fastened to the flange-like projections of the service openings with quick-locking elements.

At least one of the drums can be provided on its axis with a hydraulic revolving joint which is connected, on the one hand, through a line with a feed source for the cleaning fluid, which contains a high-pressure pump and, on the other, through a coupler plug mounted on the drum, with a nipple mounted on the second end of the first flexible tube. By this means, the flexible tube that is connected to the head can be rapidly released from the drum or attached to it, so that the tooling time is very short.

To determine the position of the head, a Pitot tube nozzle, in particular, a pneumatic one, can be attached to it.

In a similar manner, the position of the head can be determined if a pressure indicator is attached to the cleaning fluid line. The jets of fluid ejected from the nozzle on the head produce various pressures in the feed line, depending on whether the jets hit the center of a tube or go into a tube column. A sensitive pressure indicator in the control system will make it possible to determine the pressure buildup in the feed line for the cleaning fluid in a simple manner.

Another method for determining the position of the head can be implemented by mounting on the head an electrical proximity switch, whose signal lines run to the control system.

Another advantageous method is to determine the position optically by means of a narrow video probe, in particular, one with a diameter of about 6 mm, which is mounted on the head of the manipulator. If a video probe is mounted on the head, it is possible not merely to determine the position, but also to make an inspection of the heat exchanger, and of the spacing plates in particular.

It is also advantageous to mount minigrippers of repair tools and other maintenance devices on the head of the equipment.

It is particularly desirable if the suction device for the removal of the sludge/cleaning-fluid mixture has a spray head equipped with thrust nozzles and connected through a flexible pressure tube to a source of fluid, and if parallel to the pressure tube there is installed a suction tube to remove the sludge/fluid mixture, which has an intake opening in the vicinity of the jets from the thrust nozzles. By this means, the spray head, with the suction tube for removing the sludge/fluid mixture, is moved automatically, once it has been introduced through the service opening to any desired place on the periphery or hand-hole lane, so that a special drive is unnecessary. The removed particles are stirred up and can be securely removed by suction. In this case, the sludge/fluid mixture is picked up directly at the outlet of the tube column, so that it is not necessary to generate a peripheral flow around the edge of the tube bundle.

BRIEF DESCRIPTION OF THE DRAWINGS

Embodiments of the invention are shown in the drawings.

DETAILED DESCRIPTION

Figure 1:
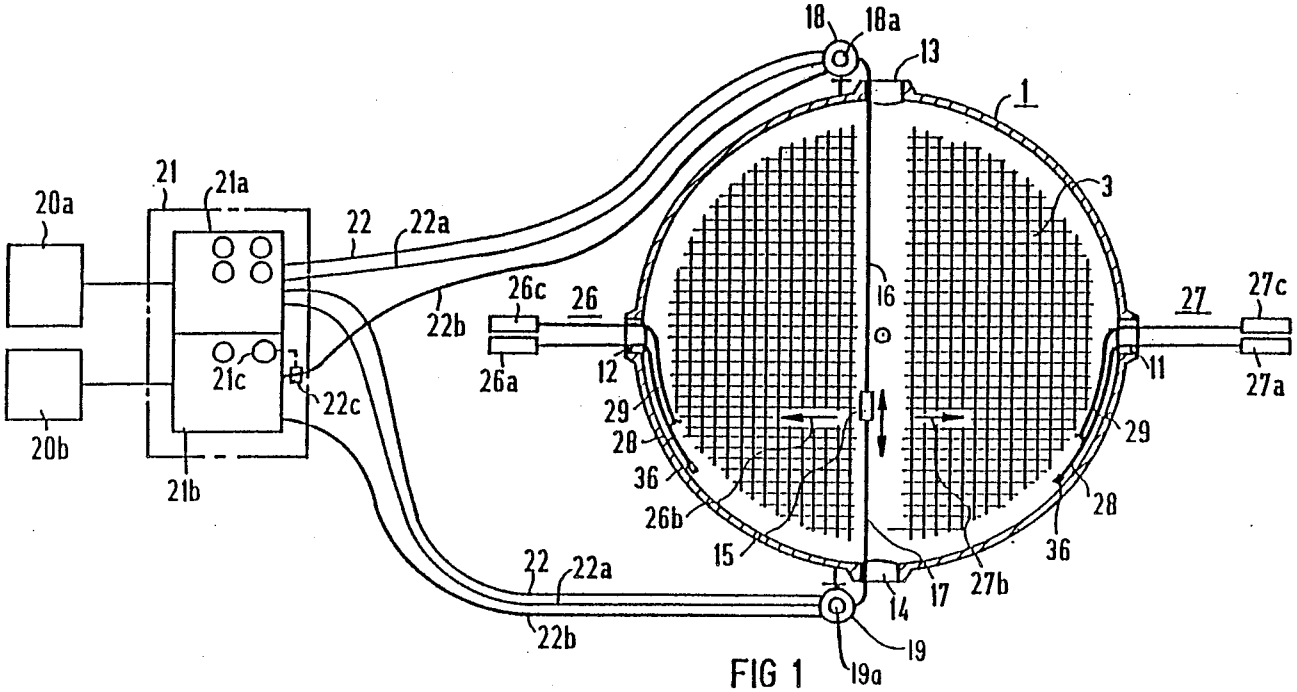
FIG. 1 shows a cross section through a heat exchanger with the head of a manipulator guided on the y-axis.
Figure 2:
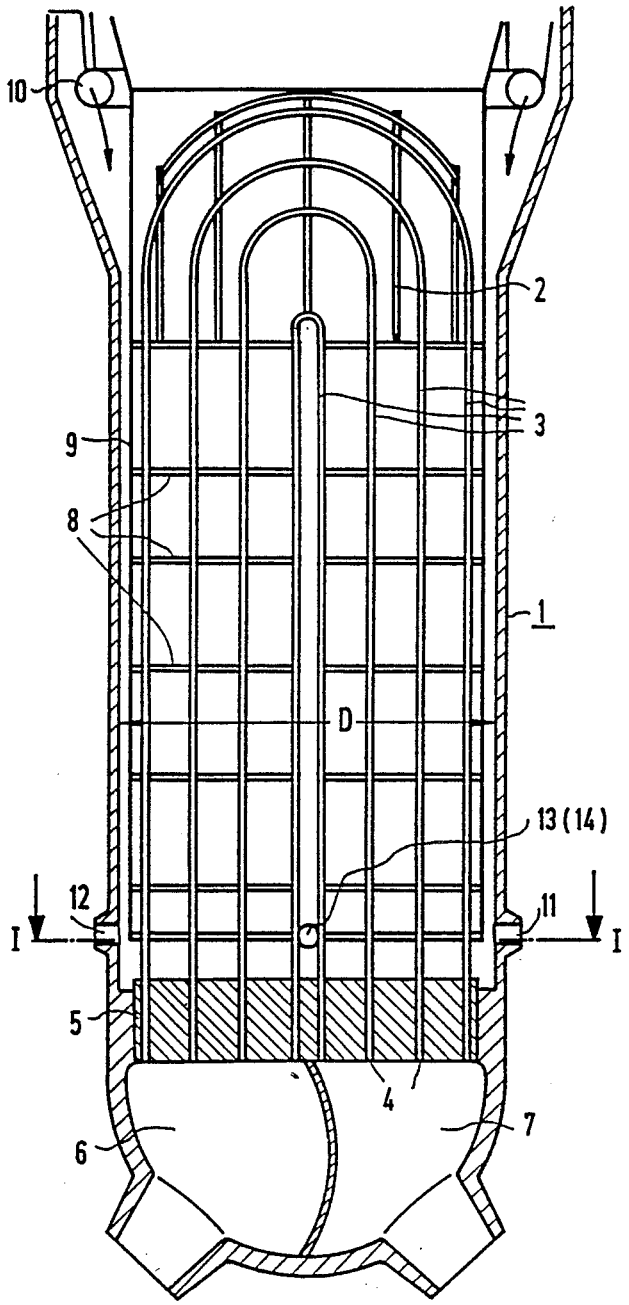
FIG. 2 shows a longitudinal section through the heat exchanger shown in FIG. 1 in a schematic rendering.

FIG. 1 shows a cross section of the heat exchanger (a longitudinal section of which is shown in FIG. 2) of a nuclear power plant in a schematic rendering. Within an enclosure or shell 1 with inside diameter D is installed a bundle of U-shaped bent heat tubes 3, provided with supporting anchors 2. (Only a few of the tubes are shown in FIG. 2, for the sake of greater clarity of presentation.) The ends of the heat tubes 3 are brought through openings 4 in a tube sheet 5 and open into chambers 6, 7. In chamber 6, a tube support has been introduced, which is connected by a tube to a reactor pressure vessel, from which the primary medium flows to the heat exchanger and through the bundle of tubes 3 is then conducted through the other chamber 7, a tube support, another tube and a pump back to the reactor pressure vessel. The heat tubes 3 are held in place by lattice-shaped spacing plates 8 and surrounded by a flow-guiding crossbaffle 9. The secondary feed water is fed through a tube 10 in such a manner that it is directed downward through the flow-guiding crossbaffle 9 and from there fills the shell volume surrounding the exterior of the heat tubes 3 as uniformly as possible from bottom to top. In the shell 1 are provided several closable service openings 11, 12, 13, 14, including hand holes and inspection ports. The service openings have a diameter of about 51 mm or less.

In FIG. 1, a square arrangement of tubes held in position by a grid is schematically represented. The spacing of the heat tubes 3 in a column is about 8 mm. For the maintenance of the secondary section of the heat exchanger, in particular, for the remote controlled removal of deposits in the tube sheet area and/or on spacing plates of the tube bundle, a manipulator is provided, whose head 15 is equipped with a nozzle, a tool or a probe. This head 15 can be moved within the heat exchanger by two flexible tubes 16, 17. The first ends of the tubes 16, 17 are fastened to two opposite sides of the head 15, while the second ends are wound onto remote-controlled drums 18, 19. From an electrical power source **20*a*, electrical power is supplied through part 21*a* of a control system 21 by means of electrical lines 22*a* to the respective drive motors 18*a*, 19*a* of the two drums 18, 19**.

At an angle of 90 degrees to the service openings 13, 14, are located the service openings 11, 12. In these openings, the suction tubes 28, 29 of two suction devices 26, 27 are inserted and then conducted along the edge of the tube bundle. In the section included within the heat exchanger, these suction tubes 28, 29 are provided with suction openings. The part of the suction tubes 28, 29 that is located outside the heat exchanger is connected to the suction pumps **26*a*, 27*a*. The direction of flow of the cleaning fluid is indicated by the arrows 26*b*, 27*b*. The fluid is sprayed in the tube lane from the nozzles of the head 15 at high pressure—for example, 100 to 200 bar—on the deposits, which are washed away to the periphery. There the fluid/sludge mixture is picked up and removed by the suction tubes 28, 29**.

Figure 5:
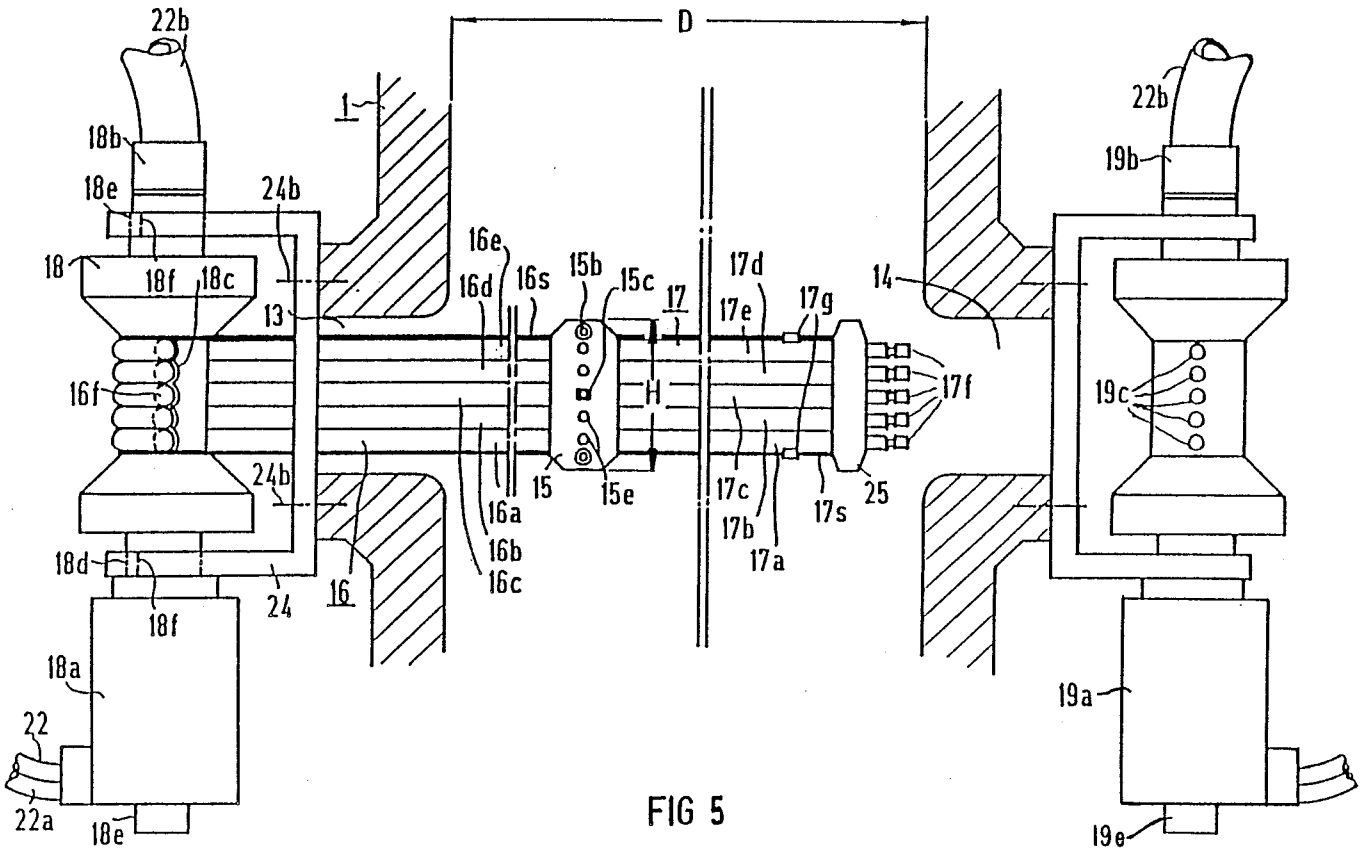
FIG. 5 shows a detail of FIG. 1.

As shown in FIG. 5, the drive motors **18*a*, 19*a* of the drums 18, 19 are DC motors with tacho-generators 18*e*, 19*e* and encoders. The DC motors are fed over the electrical lines 22*a*. From the motors 18*a*, 19*a* and the tacho-generators 18*e*, 19*e*, signal lines lead to the control system 21**.

From a hydraulic feed source **20*b* (FIG. 1) at least one of the two drums 18, 19 is supplied with cleaning fluid by means of a high-pressure pump, the control system 21 (part 21*b*) and the lines 22*b*. To the axis of the drum 18 is fastened a hydraulic rotary connection 18*b* (FIG. 5), into one side of which opens the hydraulic line 22*b*. On the other side of the hydraulic rotary connection 18*b*, a channel leads through drillings in the axis of the drum to a plug connection 18*c* mounted on the drum. This plug connection 18*c* is connected to a coupling nipple 16*f* on the second end of the first flexible tube 16. Corresponding devices are provided on the second drum 19**, if the cleaning fluid is to be conducted here as well.

The drums 18, 19 are mounted on a carrier 24, which is fastened by screws **24*b* or quick-locking elements to the inspection ports 13 and 14**, so that it can be easily removed.

The flexible tube leading to the head 15 may consist of one, two or even more individual tubes **16*a*, 16*b*, 16*c*, 16*d*, 16*e* arranged in a plane. Each of these individual tubes is designed, when the head 15 is equipped with at least one nozzle 15*e*, as a pressure tube. From the head 15, the second tube 17 leads to the second drum 19. This tube 17 may also comprise one or more individual tubes 17*a* to 17*e*. At the free end of the tube 17 is fixed an endpiece 25, at which the individual tubes 17*a* to 17*e* are brought together and provided with coupling nipples 17*f*. These coupling nipples 17*f* permit a rapid coupling with the plug connections 19*c*, which are connected through a channel in the hollow axis of the drum 19 and a hydraulic rotary connection 19*b* with the hydraulic line 22*b*, which in turn is connected through the control system 21 and the high-pressure pump to the hydraulic feed source 20*b* for the pressurized fluid. It is advantageous to supply the head 15** from two sides, because, compared with the familiar designs, the pressure loss in the thin individual tubes is substantially reduced.

Figure 6:
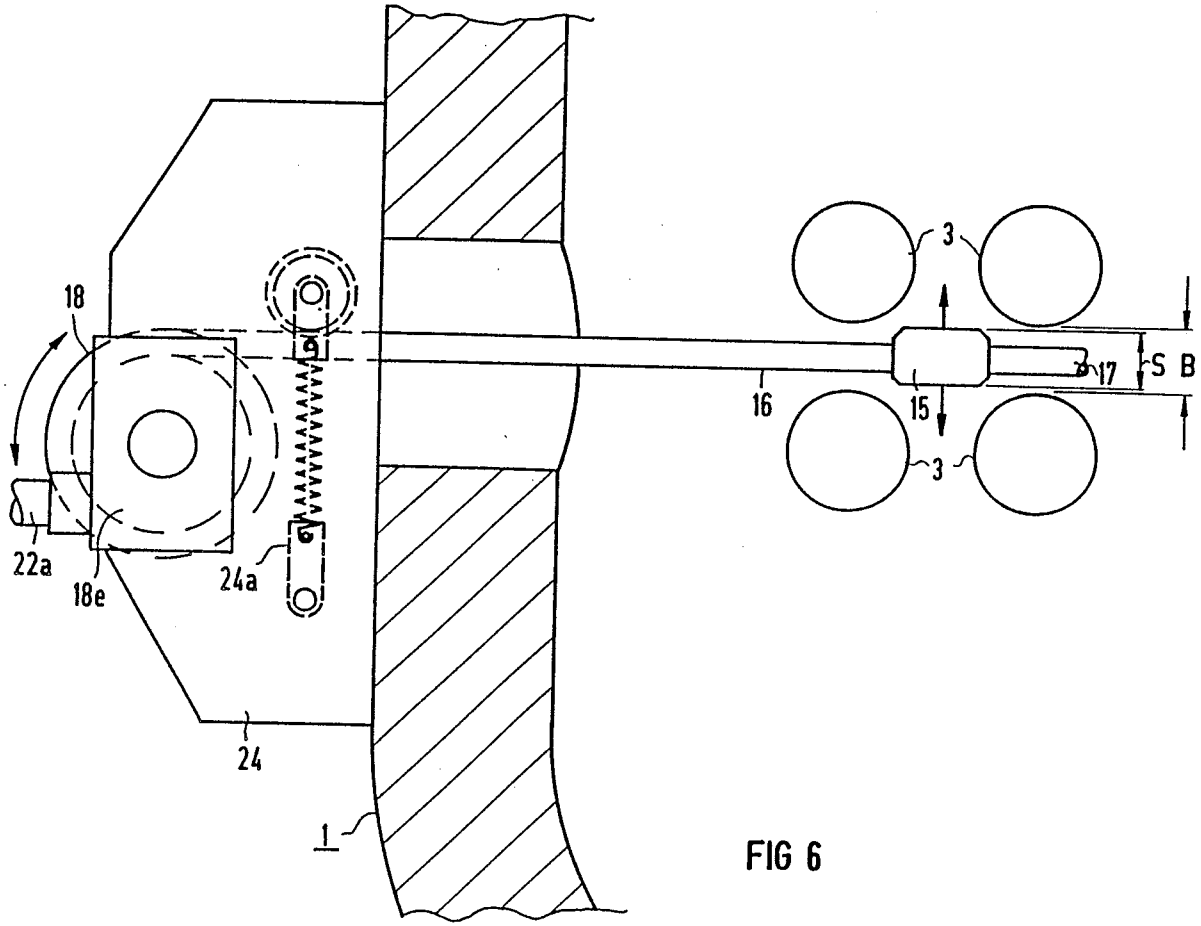
FIG. 6 shows a top view of part of the manipulator shown in FIG. 5.

In the flexible tubes 16, 17, the individual tubes 16*a* to 16*e* and 17*a* to 17*e* are arranged in a plane one above the other (see also FIG. 6). To reduce the tensile stress, a steel rope 16*s*, 17*s* is placed above and below each of the individual tubes and parallel to them.

The width B of the head 15 is only a little smaller than the column width S between the heat exchange tubes 3, which might, for example, be 7.5 to 8 mm. The width of the hoses 16, 17 is selected to be smaller than the width of the head 15. The height H of the head is smaller than the diameter of the service openings.

It is desirable if a tube clamping device 24*a* is mounted on the carrier 24 for the tube drum 18 (FIG. 6).

In installing the manipulator, the head 15 (FIG. 1) provided with a nozzle 15*e*, a tool or a probe is connected with the flexible tube 16 wound on the drum 18. The head is then brought through the service opening 13 and through the tube lane into the tube bundle and then taken out through another service opening 14. There the head 15 is connected with one end of the second flexible tube 17, which is wound onto the second drum 19. By driving one of the drums, the head 15 can be moved through the tube lane, in which case the second drum can be braked, in order to apply a desired tension to the tubes 16, 17.

If the head 15 is supplied with nozzles 15*e* to remove deposits, then it is desirable to move it intermittently through the tube lane, so that the jets of fluid are not aimed directly at the tubes, but into the tube columns. In this case the suction openings of the suction tubes 28, 29 are each positioned in such a manner that the sludge/fluid mixture is removed from the area of the sprayed tube columns.

In installing the manipulator, the head 15 may also be connected on both sides with the tubes 16 and 17 respectively, so that when the first tube 16 is wound onto the respective drum 18, the free end of the second tube 17 is brought through the first service opening 13 and the tube lane, while the end of the tube exits from the second service opening 14. The free end of the tube 17 is then wound onto the second drum 19. Through the operation of the control system 21, one of the two drums 18, 19 is activated and the head 15 moves by remote control through the tube lane.

Figure 3:
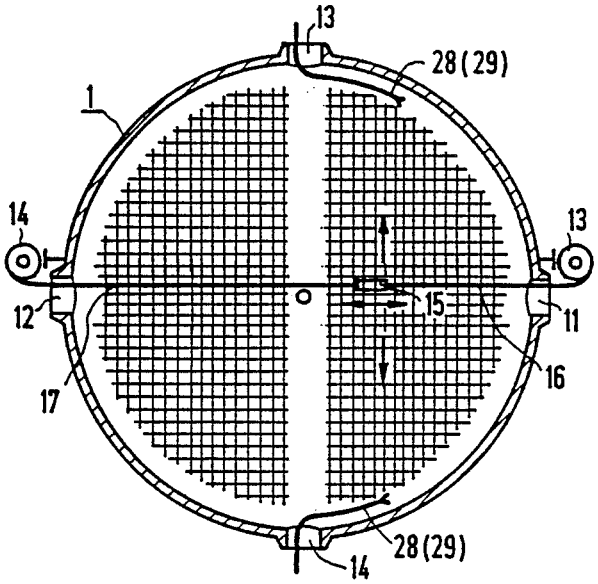
FIG. 3 shows a cross section with the head guided on the x-axis.
Figure 7:
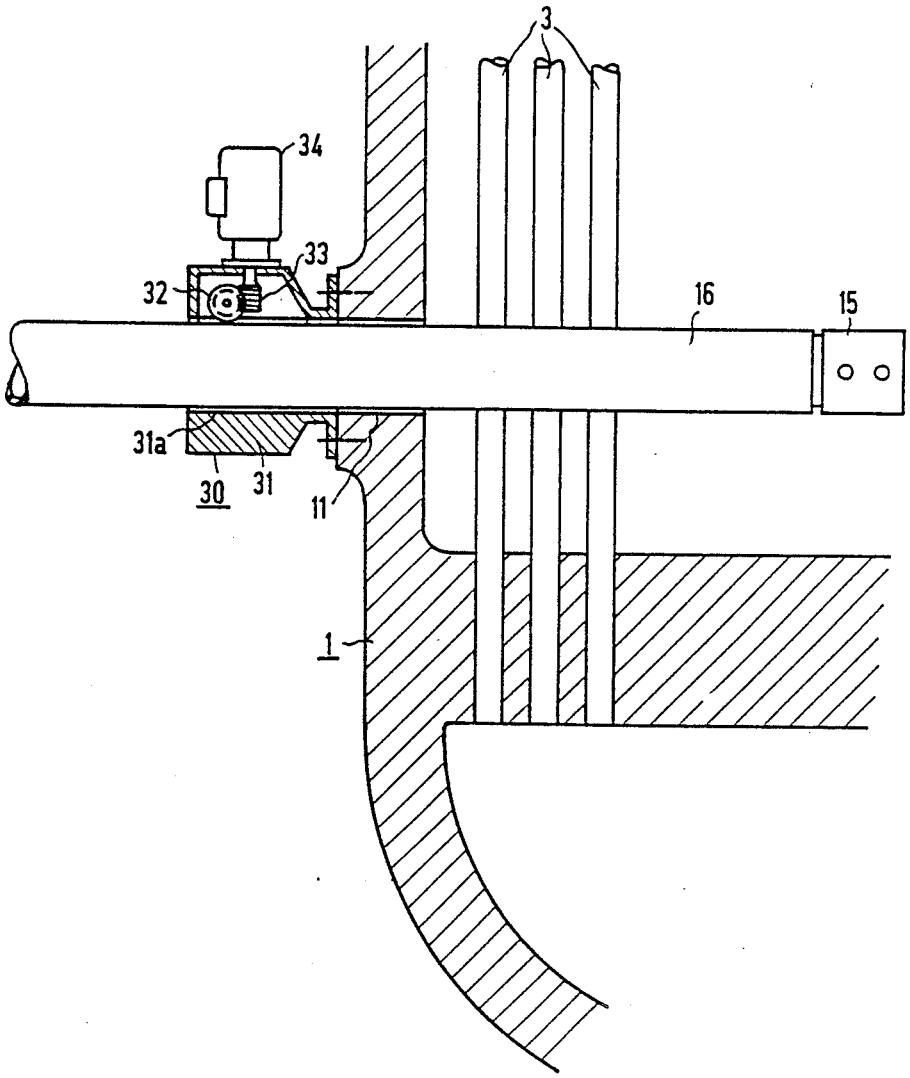
FIG. 7 shows an insertion tool for a head with flexible tubes attached to it.

As shown in FIG. 7, the installation of the manipulator can be simplified if the head 15 of the free end of the second tube 10 is inserted into the tube bundle by means of an insertion tool 30. This insertion tool 30 consists of a basic element 31, which is provided with a passage opening 31*a* for the head 15, with its attached tube 16, to pass through. Inside the opening 31 is mounted a friction wheel 32, which is pressed against the tube surface and is driven through a worm gear 33 by a motor 34. With the insertion tool 30, which is fastened to the service opening 11 at the beginning of the installation process (FIG. 3), the head 15 with the tube 16 can be guided through tube columns and picked up at an opposite opening 12 either by hand or with a gripper.

A second tube 17 wound on the second drum 19 is then connected to the head 15. After the tube 17 has been connected, the insertion tool 30 is removed, and the second drum 19 is mounted in its place.

Figure 4:
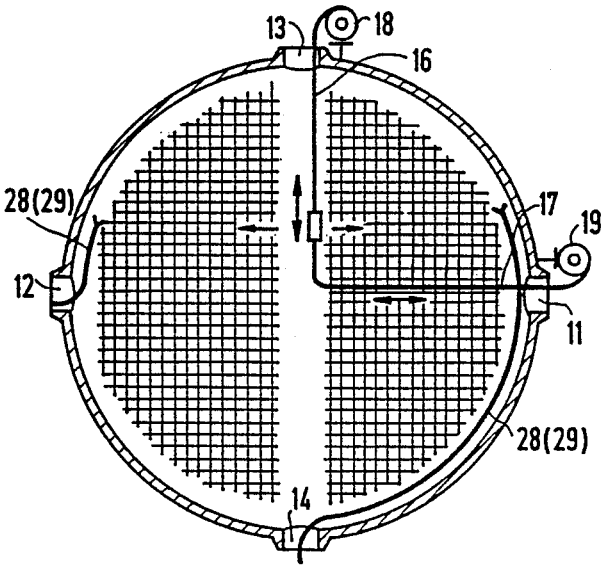
FIG. 4 shows a cross section with the head guided on the x-and y-axes.

By means of a gripper that is inserted through a service opening 13 at a 90 degrees angle to the insertion opening 11, it is also possible to grasp the head 15 in the tube lane, to draw it out through the opening 13 that is at a 90 degree angle and to connect it to a tube 17, wound on a drum 19, that has been brought to that point (see FIG. 4).

Figure 8:
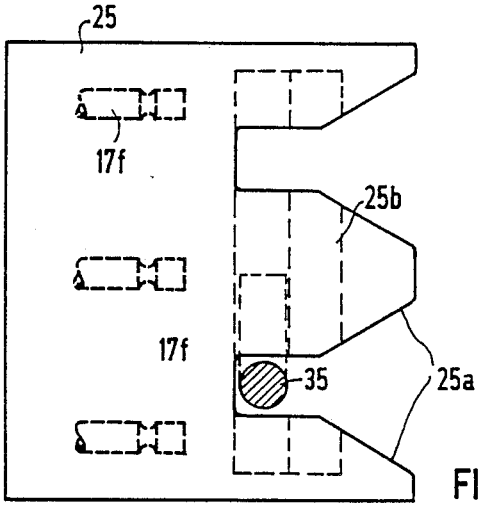
FIG. 8 shows a nozzle with a coupling nipple, to connect the flexible tubes to a plug connection which is mounted on the drum.
Figure 9:
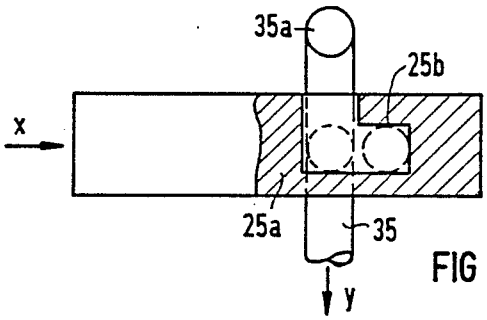
FIG. 9 shows a section of FIG. 8.

FIG. 8 is a side view of an endpiece 25, which is fixed to each end of the tubes 16, 17. This endpiece 25 comprises the hydraulic tube nipples 17*f* attached to the individual tubes. The endpiece 25 has—as shown again, in cross section, in FIG. 9—grips 25*a*, in which are provided slots 25*b* for the gripper 35. At its free end, this gripper 35 has a hook 35*a*. FIG. 9 shows a cross section of the endpiece 25. On the head 15 of the manipulator and on the drum 18, 19 are mounted the coupling plug 18*c* and 19*c* respectively, for the hydraulic tube nipple. The gripper 35 is inserted perpendicularly into the slot 25*b* and manipulated until it locks (broken lines). By this means, a tube inserted on the x-axis through a tube column can be guided onto the y-axis and brought out through the tube lane.

Figure 10:
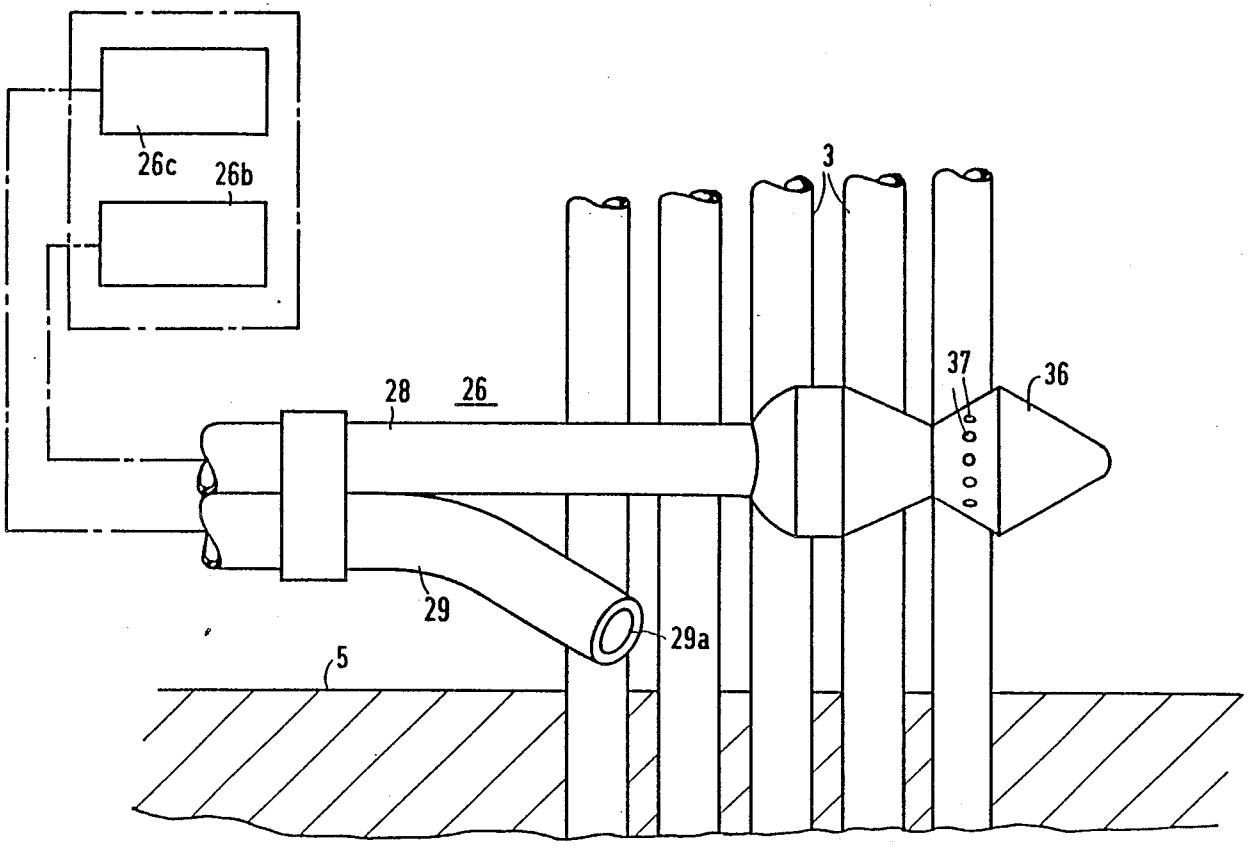
FIG. 10 shows a suction device.

FIG. 10 shows a suction device for dissolved deposits. The suction device has a head 36 provided with thrust nozzles 37 and connected through a pressure tube 28 to a fluid source 26*b*. This fluid source 26*b* can be a vessel with water or deionate, which is connected through a pump with the pressure tube 28.

Through the thrust nozzles 37, fluid is ejected backwards at an angle of approximately 30 to 70 degrees to the axis of the head 36. Parallel to the pressure tube is a suction tube 29 to draw off the sludge/fluid mixture in a receiving vessel 26*c*. The suction tube 29 has a suction opening oriented to the jet area of the thrust nozzles 37. The pressure tube 28 and the suction tube 29 are arranged on top of one another in such a manner that after the suction device has been introduced into the heat exchanger, the suction opening 29*a* is turned toward the tube sheet. The deposits that have been removed must be fed directly to the suction system, since they would otherwise be washed back into the rows of tubes, or else be precipitated, making them difficult to draw off. Since in the suction device 26 the thrust nozzles 37 are aimed backwards, an automatic forward thrust is generated, so that the nozzle head 36 and the suction tube 29 can be maneuvered to any desired position in the periphery or in the tube lane. The deionate or water that is discharged backward washes the deposits to the downstream suction tube 29. It is therefore unnecessary to generate a peripheral flow in the heat exchanger. The sludge/fluid mixture is picked up directly at the outlet of the tube column or in the tube lane. The suction tube 29 is shorter than the pressure tube 28, with the distance between the thrust nozzles 37 and the suction opening 29*a* amounting to about two to five tube divisions.

The control system 21 is located outside the control area, from which point all the movements of the manipulator can be remote-controlled. The procedures described below, which can also be combined with one another, can be used to position the nozzle head 15 precisely with respect to the tube columns.

As shown in FIG. 5, the drive motor 18*a* is equipped with a tacho generator 18*e*. This tacho generator 18*e* is connected through signal lead 22 with the control system 21. In the tacho generator, signal values concerning the path traveled by the tube 16, and, accordingly, by the head 15 are generated. With the aid of theoretically determined values the head 15 can be guided into any desired position. The absolute path is indicated on an instrument in the control system 21. If the head 15 is provided with one or more nozzles 15*e* for the removal of deposits, then the head can be positioned according to the indicated values, and the supply of the cleaning fluid can be stopped precisely when the nozzles 15*e* pass the heat tubes 3.

A step-by-step forward movement of the head 15 can also be accomplished as a function of the amount of current in one of the two drive motors 18*a*, 19*a*. This procedure is based on the fact that the width B of the head 15 is somewhat larger than that of the tubes 16, 17 and that the head 15 engages, so to speak, between the tube columns. To move the head 15 forward or backward, the drive motors must therefore produce a somewhat greater output, which results in an increased power consumption, which is detected by a measuring instrument in the control system 21. In this manner the position of the head 15 with respect to the tube 3 or the tube column can be followed and controlled accordingly.

In order to position the head, it is also possible to determine as signals the thrust of the nozzle jet, in particular, the pressure exerted on the bearings 18*d* of at least one drum 18 (FIG. 5) or the tensions on the bundle of individual flexible tubes 16*a* to 16*e* and to transmit them to the control system 21. This procedure is based on the fact that the thrust of the head 15 is most effective when the fluid is ejected from only one side of the head 15 and the ejection force remains steady. The ejection forces are at a minimum when the nozzle jet sprays between the heat tubes and are almost twice as large when the nozzle jet is trained directly on a heat tube. To determine the signals, the system shown in FIG. 5 employs a force measuring device 18*f* on the bearings 18*d* of the drums. To measure the tension on the individual flexible tubes 16*a* to 16*e*, tension measurement sensors 17*g* can be installed on the steel ropes 17*s*, which are arranged parallel to the bundles of individual tubes 17*a* to 17*e*.

Another possibility is to mount on the head 15 a Pitot tube 15*b*, particularly a pneumatic one, whose signal values are fed to the control system 21.

A similar effect can be achieved by installing a pressure sensor 22*c* in the line 22*b* (FIG. 1) for the cleaning fluid. The pressure sensor 22*c* can be installed directly in the control system 21 and connected to a pressure indicator 21*c*.

In addition, the positioning can be accomplished by means of an electrical proximity switch 15*c* mounted on the head 15 (FIG. 5).

Figure 11:
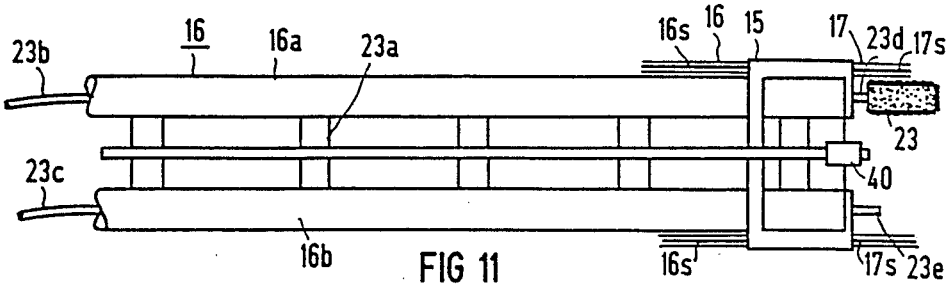
FIG. 11 shows a manipulator head with a video probe.

Optical positioning can be achieved by means of a very narrow video probe 40, which can swivel by remote control, has a diameter of about 6 mm and is mounted on the head 15 (FIG. 11). In two individual flexible tubes 16*a*, 16*b*, which are held together by flanges 23*a*, flexible axes are mounted, each of which has a tightening pin 23*e* on the head 15. These tightening pins can be rotated from outside and can hold a tool 23, for example, a brush.

I claim:

1. A method for selectively positioning a manipulator head in a secondary section of a heat exchanger having a shell housing, cooling tube columns within the housing which are spaced apart by lanes, and at least two service openings defined by the housing comprising the steps of:

routing the manipulator head and a first flexible tube that is windable about a first drum through a first service opening and a second flexible tube that is windable about a second drum through a second service opening, with the first and second flexible tubes being coupled to the head; and selectively positioning the head to a desired location within the heat exchanger with the control system by driving at least one of the drums having a corresponding flexible tube wound thereabout with a drive unit that is connected to a control system.

2. The method of claim 1, wherein the routing step comprises:

coupling the manipulator head to the first flexible tube;

passing the head and first flexible tube through the first service opening;

drawing the head out of the second service opening exterior the housing; and coupling the head to the second flexible tube.

3. The method of claim 1, wherein the routing step comprises:

coupling the manipulator head to the first and second flexible tubes;

drawing a second end of the second flexible tube into the first service opening and out of the second service opening exterior the housing; and connecting the second flexible tube second end to the second drum.

4. The method of any one of claim 1 through 3, further comprising the step of cleaning the heat exchanger interior by forcing pressurized cleaning fluid through the first flexible tube and through a nozzle attached to the head which is in fluid communication with the first flexible tube.

5. The method of claim 1, wherein the manipulator head has a tool coupled thereto.

6. The method of claim 1, wherein the manipulator head has a probe coupled thereto.

7. The method of claim 1, wherein at least part of the routing is performed with an insertion tool.

8. The method of claim 1, wherein the positioning step includes sensing generator signals with the control system which are generated by a tachogenerator connected to such system and to the first drum, with the control system comparing the generator signal with a predetermined signal value that is indicative of a desired head position.

9. The method of claim 1, wherein at least one of the drums is driven by a step motor which is connected to the control system and the selective positioning is accomplished by varying electrical current that is fed by the control system to the motor.

10. The method of claim 4, wherein the selective positioning includes sensing with sensors loads on rotative bearings of at least one of the drums or tensile stresses on at least one of the flexible tubes that are created by fluid forced through the head nozzle, generating sensor signals with the sensors, feeding the sensor signals to the control system and utilizing the sensor signals in the control system to determine the head position.

11. An apparatus for selectively positioning a manipulator head in a secondary section of a heat exchanger having a shell housing, cooling tube columns within the housing which are spaced apart by lanes, and at least two service openings defined by the housing comprising:

a manipulator head that is insertable through at least one of the service openings;

first and second flexible tubes connected to the manipulator head, the first flexible tube insertable through the first service opening and windable about a first drum and the second flexible tube insertable through the second service opening and windable about a second drum, with at least one of the flexible tubes being wound about its respective drum;

at least one source connected to at least one of the flexible tubes and drums; and at least one of the drums having a drive unit connected to a control system for controlling drum drive movement, so as to position selectively the manipulator head to desired locations within the heat exchanger, the control system being connected to the source for controlling feed from the source.

12. The apparatus of claim 11, further comprising a tool attached to the manipulator head that is insertable through at least one of the service openings.

13. The apparatus of claim 11, further comprising:

an electrical probe attached to the manipulator head that is insertable through at least one of the service openings; and an electrical signal line connected to the source, at least one of the flexible tubes and its respective drum, and the probe.

14. The apparatus of claim 11, further comprising:

a nozzle attached to the manipulator head that is insertable through at least one of the service openings;

a pressurized fluid feed connected to the source, at least one of the flexible tubes and its respective drum, and the nozzle, for cleaning the heat exchanger interior with pressurized fluid that is forced through the nozzle; and at least one suction device for removing fluids from the heat exchanger.

15. The apparatus of claim 14, wherein the manipulator head includes a pitot tube nozzle.

16. The apparatus of claim 14, wherein the fluid feed has a pump and a fluid feed line, at least one of the drums has a hydraulic revolving joint oriented along a drum rotative axis, a coupling plug connects the fluid feed line and the joint, a coupling nipple is connected to the drum in fluid communication with the coupling plug, and the flexible tube which is associated with such drum has an end that is distal the manipulator head which is attached in fluid communication with the coupling nipple.

17. The apparatus of claim 16, wherein the fluid feed line has a pressure indicator.

18. The apparatus of claim 11, wherein the first drum is fastened to the first service opening and the second drum is fastened to the second service opening with fastening elements, and wherein at least one of the drum fastening elements is a quick-locking fastening element.

19. The apparatus of claim 11, wherein the manipulator head has a proximity switch attached thereto.

20. The apparatus of claim 13, wherein the probe is a video probe.

21. The apparatus of claim 11, wherein at least one of the flexible tubes comprises at least two individual tubes which are oriented in a plane.

22. The apparatus of claim 11, wherein a steel rope is oriented parallel to at least one of the flexible tubes.

23. The apparatus of claim 14, wherein the suction device has a spray head having thrust nozzles that are connected through a pressure tube and a pump to a fluid source, and a suction tube parallel to the pressure tube having a suction opening oriented within range of fluid jets created by the thrust nozzles.

* * * * *